United States Patent [19]

Kosoegawa et al.

[11] 3,959,664

[45] May 25, 1976

[54] ANTICORROSIVE CIRCUIT FOR A BURIED STRUCTURE

[75] Inventors: Eiiti Kosoegawa, Nishinomiya; Kazuo Fujimoto, Takatsuki; Yoshimi Tanaka, Kyoto; Yuichiro Takayama; Hirotsugu Hattori, both of Takatsuki, all of Japan

[73] Assignee: Matsushita Electric Industrial Co., Ltd., Japan

[22] Filed: Nov. 7, 1974

[21] Appl. No.: 521,570

[30] Foreign Application Priority Data

Nov. 12, 1973 Japan ..... 48-127489
Nov. 13, 1973 Japan ..... 48-127514

[52] U.S. Cl. ..... 307/95
[51] Int. Cl.[2] ..... B01D 13/02
[58] Field of Search ..... 307/95; 204/147, 196; 321/15, 45 C

[56] References Cited

UNITED STATES PATENTS 3,612,898 10/1971 Doniguian ..... 307/95

*Primary Examiner*—Herman T. Hohauser
*Attorney, Agent, or Firm*—Burgess, Ryan and Wayne

[57] ABSTRACT

A cathodic protection, anticorrosive circuit comprises a diode connection of a transistor or a Schotkky diode interconnected between a buried structure to be protected and a galvanic anode or the like so that even when the difference in potential between them is relatively low, an effective forward or anticorrosion current may flow while positively preventing the reverse current which causes the corrosion of the buried structure.

8 Claims, 5 Drawing Figures

ANTICORROSIVE CIRCUIT FOR A BURIED STRUCTURE

BACKGROUND OF THE INVENTION

The present invention relates generally to cathodic protection, and more particularly, to an anticorrosive circuit in which a rectifier is interconnected between a buried structure to be protected from corrosion and a galvanic anode or low-resistant grounding metal or alloy buried in a suitably spaced apart relationship with the buried structure.

In general, buried structures such as underground gas or water pipes are subjected to corrosion by electrolytic action from unidirectional electric currents in the ground. These currents may result from galvanic couples in the ground, track returns in street-railway systems and electrified railroads, or a variety of other causes. Furthermore, the buried structures are also subjected to corrosion by electrolytic action from the electric currents flowing from anodes to cathodes of microcells or macrocells formed because of the local differences in the buried structures and the environments surrounding them.

The method of widest use for protecting the buried structures from electrolytic corrosion is cathodic protection. For instance, a galvanic anode made of a metal such as magnesium having a higher potential than the buried structure or low-resistive grounding metal or alloy equivalent in conductivity to the galvanic anode is buried in the vicinity of the buried structure, and is electrically connected thereto so that the anticorrosion current may flow from the galvanic anode or low-resistive grounding metal or alloy through the corrosive environment to the surface of the buried structure. In another cathodic protection method, an external current source is interconnected between a buried structure and an auxiliary electrode so that sufficient DC current may enter the entire surface of the structure. In the so-called "discharge system", the current leaking from the tracks of the electrified railroads or street-car systems is used. The point or points on the buried structure which is higher in potential that the tracks are electrically connected to the tracks so that the currents flow into the surrounding soil from the buried structure. From all of the considerations of the installation and maintenance including their cost, and safety, these cathodic protection methods are advantageous in that they may be applied almost under any environmental conditions; the maintenance after the installation is almost free, thus resulting in the considerable reduction in maintenance cost; the absolute magnitude of the flowing current is relatively low so that no interference problem will occur; and that the control of the potential of the buried structure relative to that of the surrounding soil may be relatively easily and correctly controlled. However, because of the reasons to be described hereinafter, the bove cathodic protection methods cannot be used under some environmental conditions. Especially in case of the first of the above three methods, even when the galvanic anode made of metallic magnesium is used, the potential difference between the buried structure and the galvanic anode is of the order of 0.6 to 0.7 volts (1.0 volt at the most) so that the potential difference most frequently tends to be cancelled by the stray currents. Thus, no effective anticorrosion current flows, and, in some cases, reverse current flows resulting in the corrosion of the buried structure. Furthermore, (1) each galvanic anode must provide the steady anticorrosion current of the order of 10 to 40 mA (more preferably 20 to 30 mA regardless of the different corrosive environmental conditions), and (2) in some cases, but not always, a reverse voltage of the order of tens volts at the maximum is impressed due to the stray currents in the ground so that the positive and effective cathodic protection cannot be attained unless the anticorrosion current flows even when the maximum reverse voltage is impressed. In order to solve these problems. it has been proposed to use semiconductor diodes available at the market. However, as is clear from their voltage-amper characteristic curves, when the reverse voltage is impressed across them, they may effectively prevent the reverse current; that is, corrosion current, but they cannot provide the sufficient and steady flow of forward current; that is, anticorrosion current. The reason is that with a conventional p-n diode, the effective anticorrosion current (forward current) flows only when the forward voltage of the order of 0.35 to 0.7 volts is impressed, but when the forward voltage is of the order of 0.1 to 0.2 volt, almost no forward current flows. Thus the conventional p-n diodes exhibit a poor forward current raising characteristic. As a result, the conventional p-n diodes cannot be used when the effective electromotive force or the effective difference in potential between the galvanic anode and the buried structure to be protected is unexpectedly low under some special environmental conditions which are very difficult to be investigated in advance.

SUMMARY OF THE INVENTION

One of the objects of the present invention is therefore to provide a cathodic protection circuit which may provide sufficiently effective and positive anticorrosion current even when the electromotive force between a buried structure to be protected and a galvanic anode or low-resistive grounding metal or alloy.

Another object of the present invention is to provide a cathodic protection circuit capable of the positive prevention of the reverse current which causes corrosion of a buried structure.

A further object of the present invention is to provide an economical cathodic protection circuit which is very simple to install, maintain and repair.

Briefly stated, according to the present invention, an anticorrosive circuit comprising a diode connection circuit of a transistor or a Schotkky diode is interconnected between a buried structure to be protected and a galvanic anode or low-resistive grounding metal or alloy so that the anticorrosion current may positively flow due to the electromotive force between the buried structure and the galvanic anode or low-resistive grounding metal or alloy while positively preventing the reverse corrosion current.

DESCRIPTION OF THE PREFERRED EMBODIMENT

Figure 1:
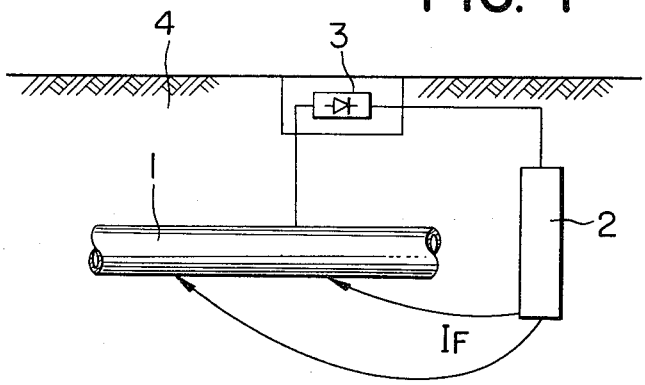
FIG. 1 is a schematic view of a cathodic protection circuit in accordance with the present invention.
Figure 2:
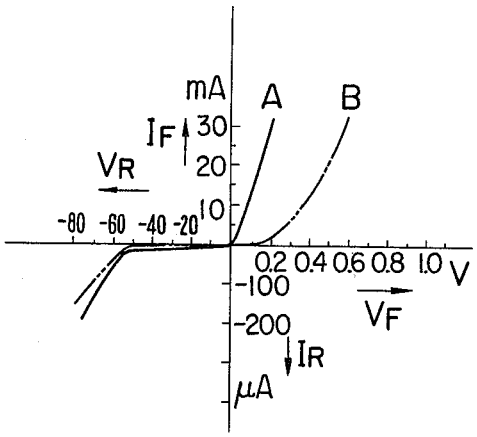
FIG. 2 is a graph illustrating the voltage-amper characteristic curve of a rectifier in accordance with the present invention in comparison with that of a conventional semiconductor diode.

Referring to FIG. 1, a buried structure 1 to be protected such as a gas or water pipe is electrically connected to a galvanic anode or low-resistant grounding metal or alloy 2 of greater potential than the buried structure 1 to be protected, which anode is made of, for instance, metallic magnesium and is also buried a suitably spaced apart relationship with the buried structure 1 to be protected so that, due to the difference in galvanic potential between the buried structure 1 and the buried galvanic anode or low-resistive grounding metal or alloy 2 to be referred to as "the galvanic anode" for brevity hereinafter, the anticorrosion current may flow through a closed circuit consisting of the galvanic anode 2, the surrounding soil 4, and the buried structure 1 to be protected; that is, the anticorrosion current flows from the galvanic anode 2, the surrouding soil 4, the buried structure 1, and the surrounding soil 4 to the galvanic anode 2. According to the present invention, a rectifier 3 is interconnected between the buried structure 1 and the galvanic anode 2 so that even when the electromotive force between them is of the order of 0.1 volt, an effective anticorrosion current of the order of 10 to 40 mA may flow. The rectifier 3 may be of the transistor or Schotkky diode type which, as shown in FIG. 2 at (A), exhibits such an ampere-voltage characteristic curve (a) that the forward voltage drop is small, (b) that the forward current $I_F$ rises sharply; and (c) that it effectively blocks the corrosion or reverse current $I_R$. For the sake of comparison, the ampere-voltage characteristic curve of a conventional semiconductor diode is shown at (B) in FIG. 2.

Figure 3:
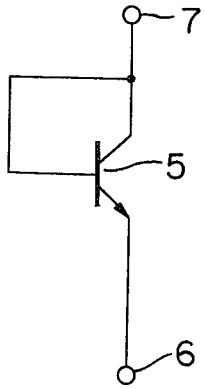
FIG. 3 is a diagram of a diode connection circuit of a transistor in accordance with the present invention.
Figure 5:
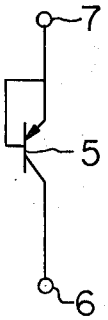
FIG. 5 is a modification of the circuit of FIG. 3.

Next referring to FIG. 3, the diode connection of the transistor rectifier in accordance with the present invention will be described. The base and collector electrodes of a transistor 5 are connected to each other, and a cathode terminal is indicated by 6 while an anode terminal, by 7.

Figure 4:
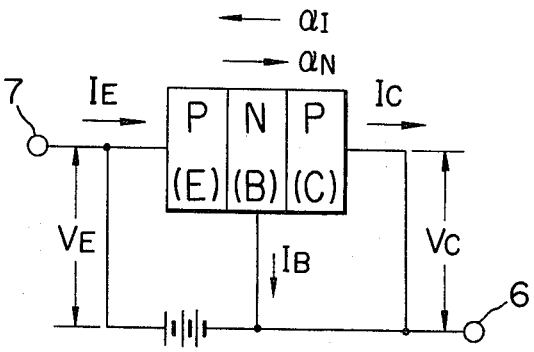
FIG. 4 is a view used for; explanation thereof.

When a p-n-p transistor is used, the connection is made as shown in FIG. 4. With this connection, the common-base amplification factor or transistor alpha may be made larger than unity with the improved forward current rising characteristic when the forward voltage is applied as will be described in more detail hereinafter. With a small current; that is, with less injection of the minority carrier, the following equations are held in the terms of a circuit known as the Evers-Moll's equation:

$$I_E = -\frac{I_{E0}}{1-\alpha_N\alpha_I}\left(e^{\frac{qV_E}{KT}}-1\right)-\frac{\alpha_I I_{C0}}{1-\alpha_N\alpha_I}\left(e^{\frac{qV_E}{KT}}-1\right) \quad (1)$$

$$I_C = -\frac{\alpha_N I_{E0}}{1-\alpha_N\alpha_I}\left(e^{\frac{qV_E}{KT}}-1\right)-\frac{I_{C0}}{1-\alpha_N\alpha_I}\left(e^{\frac{qV_E}{KT}}-1\right) \quad (2)$$

$$I_B = I_E - I_C \quad (3)$$

where $I_{E0}$: emitter-junction reverse saturation current,
$I_{C0}$: collector-base reverse saturation current;
$\alpha_N$ : common-base transistor alpha in the normal fashion;
$\alpha_I$ : common-base transistor alpha in the inverted fashion;

$I_E$ : emitter current
$I_B$ : base current
$I_C$ : collector current;
$K$ : Boltzmann's constant;
$q$ : charge
$V_E$ : emitter voltage;
$V_C$ : collector voltage; and
$T$ : temperature in °K.

Since the collector and base are interconnected, $V_C$ is zero. Substituting $V_C = 0$ into Eqs. (1), (2), and (3), we have $$I_E = +\frac{I_{E0}}{1-\alpha_N\alpha_I}\left(e^{\frac{qV_E}{KT}}-1\right) \quad (4)$$

$$I_C = -\frac{\alpha_N I_{E0}}{1-\alpha_N\alpha_I}\left(e^{\frac{qV_E}{KT}}-1\right) \quad (5)$$

$$I_B = -\frac{I_{E0}}{1-\alpha_N\alpha_I}\left(e^{\frac{qV_E}{KT}}-1\right) \quad (6)$$

In case of the conventional diode, only the emitter-base junction in FIG. 4 is used so that the anode current $I_{E'}$ is equal to the cathode current. That is, $$I_{E'} = I_{B'} = -I_{E0}\left(e^{\frac{qV_E}{KT}}-1\right) \quad (7)$$

Therefore, when the same forward bias is applied to the connection shown in FIG. 4 and to the conventional diode, the rectification current ratio $A = I_E/I_{E'}$ is given by $$A = \frac{I_E}{I_E} = \frac{\frac{I_{E0}}{1-\alpha_N\alpha_I}\left(e^{\frac{qV_E}{KT}}-1\right)}{-I_{E0}\left(e^{\frac{qV_E}{KT}}-1\right)} = \frac{1}{1-\alpha_N\alpha_I} \quad (8)$$

In general, $1 > \alpha_N > \alpha_I > 0$, so that the rectification current ratio $I_E/I_{E'}$ is greater than unity.

For instance the rectification current ratio $A = I_E/I_{E'}$ between the diode connection of the alloy junction Ge transistor 2SB126 in accordance with the present invention and the conventional diode only with the base-emitter junction, is of the order of 10.

As described hereinbefore, in the diode junction circuit of a transistor in which the base and collector electrodes are connected to each other, may increase $I_E$ about 10 times as much as the current $I_{E'}$ of a conventional diode when the electromotive force between the buried structure 1 and the glavanic anode 2 is applied to the diode junction as the forward bias voltage. That is, when $\alpha_N \cdot \alpha_I$ approaches unity in Eq. (8), $1-\alpha_N \cdot \alpha_I$ approaches zero so that the rectification current ratio $A$ is increased. Thus when a transistor whose $\alpha_N \cdot \alpha_I$ is substantially equal to unity is selected, the diode connection circuit with a considerably high rectification current ratio $A$ may be obtained.

So far the transistor has been described as having its base and collector electrodes connected to each other, but it is to be understood that the same effect may be attained even when the base and emitter electrodes are interconnected.

According to the present invention, the rectifier 3 of the type described is interconnected between the buried structure 1 and the galvanic anode 2 so that even when the difference in galvanic potential between them which is applied as the forward bias voltage across the rectifier 3 is as small as 0.1 to 0.2 volts, the forward current or the anticorrosion current of the order of 20 mA to 30 mA may flow. Thus effective anticorrosion current may be secured so that 100% performance of the galvanic anode 2 may be ensured. Moreover, even when the reverse voltage is of the order of 50 volts, the reverse current may be effectively limited to 0.5 to 0.6 mA, which is the order of the leakage current. Thus it is seen that the very positive protection for the buried structure 1 against corrosion may be provided.

As described hereinbefore, a Schotkky diode in which an n-type or p-type semiconductor contacts a metal may be used instead of the transistor. When the forward voltage is applied across the Schotkky diode, the free electrons of the metal flows across the barrier between the metal and the semiconductor into the semiconductor region as the minority carriers, and are stored there and diffused so that they become the majority carrier. In a Schotkky diode with an n-material and a metal, the current tends to flow from the metal to the semiconductor material. Therefore, a metal whose work function is as low as is practically possible must be selected in order to make the difference between the affinity of the semiconductor material and the work function of the metal as small as possible. Thus the forward bias barrier may be lowered so that the rectifier 3 with considerably improved forward current rising characteristic may be provided. On the other hand, when a p-type material is used, the current tends to flow from the semiconductor material to the metal so that, in order to make the difference between the affinity of the semiconductor material and the work function of the metal as small as possible, a metal with a work function as high as is practically possible must be selected. Thus, the forward bias barrier may be raised so that the rectifier 3 with considerably improved forward current rising characteristic may be also provided.

As described hereinbefore, the most important feature of the present invention resides in the fact that, instead of a conventional p-n diode which is effective in preventing the reverse current, but has such a poor forward current rising characteristic that the forward current almost does not flow when the forward bias voltage is as low as 0.1 to 0.2 volts, is used the rectifier 3 in which the forward voltage drop required for flowing the forward current; that is, the anticorrosion current is very small; that is, which has an excellent forward current rise characteristic curve, and which is very effective in preventing the reverse current which causes corrision of the buried structure 1. Therefore even when the difference in potential between the buried structure 1 and the galvanic anode 2 is less than the effective potential of the order of 0.6 to 0.7 volts sufficient to permit to flow the effective anticorrosion current of the order of 10 to 40 mA, and is, for instance, of the order of 0.1 to 0.2 volts due to the external influences such as leakage currents from the track returns in the electrified railroads which currents cannot be correctly estimated in advance because of the environmental conditions, the forward current of the order of 20 to 30 mA may be ensured. This is the forward current that can positively prevent the corrosion of the buried structure 1. In other words, regardless of the fact that the above described influences continue only for a short time or continuously, the effective anticorrosion current may continuously and always flow. Moreover, the reverse or corrosion current can be positively prevented.

The rectifier 3 in accordance with the present invention comprises a very miniature single element which consists of the diode junction of a transistor or a Schotkky diode so that the cost is inexpensive, the service life is long, and the operation is highly reliable opposed to the conventional rectifiers using relay circuits. Moreover, the rectifiers 3 in accordance with the present invention may be very easily installed along a long pipe line or cable, and the maintenance and repair are also much facilitated. Especially the service life of the rectifiers 3 corresponds to that of the galvanic anode made of metallic magnesium so that the cost for maintenance may be also considerably reduced. Thus the rectifiers of the present invention are very advantageous from all of these technical, industrial and economical considerations.

What is claimed is:

1. In a cathodic protection circuit having no external power supply in which a buried structure to be protected is electrically connected through the corrosive environment to a buried galvanic anode or low-resistive grounding metal or alloy so that, due to the relatively small electromotive force between said buried structure to be protected and said galvanic anode or low-resistive grounding metal or alloy, an anticorrosion current may flow from said galvanic anode or low-resistive metal or alloy through the corrosive environment and said buried structure to be protected back to said galvanic anode or low-resistive grounding metal or alloy, the improvement wherein said cathodic protection circuit for said buried structure comprises a rectifier interconnected between said buried structure to be protected and said galvanic anode or low-resistive grounding metal or alloy, said rectifier capable of conducting anticorrosion current at said relatively low electromotive force and of preventing reverse current which causes the corrosion of said structure to be protected.

2. A cathodic protection circuit as defined in claim 1 wherein said rectifier comprises a diode connection of a transistor in which said diode connection is forward biased by said relatively low electromotive force.

3. A cathodic protection circuit as defined in claim 2 wherein the emitter and base electrodes of said transistor are connected to each other at a common terminal to form a two-terminal element having said common terminal as one terminal and the collector electrode as the other terminal.

4. A cathodic protection circuit as defined in claim 2 wherein the collector and base electrodes of said transistor are connected to each other at one common terminal to form a two-terminal element having said common terminal as one terminal and the emitter electrode as the other terminal.

5. A cathodic protection circuit as defined in claim 1 wherein said rectifier comprises a Schotkky diode so connected that said relatively low electromotive force forward-biases said Schotkky diode.

6. A cathodic protection circuit as defined in claim 1 wherein said rectifier has a voltage-current characteristic in the forward direction to be conductive in the forward direction with a voltage thereacross of 0.2 volts.

7. A cathodic protection circuit as defined in claim 6 wherein said rectifier has a forward voltage current characteristic to conduct at least 30 milliamperes with a voltage thereacross of 0.2 volts.

8. A passive cathodic protection circuit for protecting a conductive buried structure against corrosion, comprising a galvanic anode buried adjacent said buried structure, and a rectifier interconnected between said buried structure and said galvanic anode, said rectifier being pulled to conduct anticorrosion current from said galvanic anode to said buried structure and to inhibit flow of current in the opposite direction, said rectifier having a current voltage characteristic to conduct at least 30 milliamperes in the forward direction with a voltage thereacross of 0.2 volts, said structure and the material in which said structure and galvanic anode are buried constituting the sole direct electrical interconnection with said cathodic protection circuit.

* * * * *